United States Patent [19]

Hage et al.

[11] 4,425,942

[45] Jan. 17, 1984

[54] FINNED TUBE FOR A HEAT EXCHANGER

[75] Inventors: Manfred Hage, Ulm-Wiblingen; Gerhard Schinköth, Neu-Ulm/Pfuhl, both of Fed. Rep. of Germany

[73] Assignee: Wieland-Werke A.G., Ulm, Fed. Rep. of Germany

[21] Appl. No.: 328,756

[22] Filed: Dec. 8, 1981

[30] Foreign Application Priority Data

Dec. 24, 1980 [DE] Fed. Rep. of Germany ..... 3048959

[51] Int. Cl.[3] ..... F15D 1/06

[52] U.S. Cl. ..... 138/38; 72/276; 165/133

[58] Field of Search ..... 138/38, 37, 39; 165/133, 179, 183, 184; 264/288.4; 428/36; 72/274, 276, 367

[56] References Cited

U.S. PATENT DOCUMENTS

| | | | |
|---|---|---|---|
| 3,267,563 | 8/1966 | Seaton | 138/38 X |
| 3,267,564 | 8/1966 | Keyes | 165/179 X |
| 3,273,599 | 9/1966 | Heeren | 138/38 |
| 3,402,767 | 9/1968 | Bohdansky et al. | 138/38 X |
| 3,612,175 | 10/1971 | Ford et al. | 138/38 X |
| 4,314,587 | 2/1982 | Hackett | 138/38 |
| 4,349,949 | 9/1982 | Kritzer | 165/179 X |

FOREIGN PATENT DOCUMENTS

| | | | |
|---|---|---|---|
| 802854 | 2/1951 | Fed. Rep. of Germany | 165/179 |
| 1767057 | 3/1958 | Fed. Rep. of Germany . | |
| 1126431 | 3/1962 | Fed. Rep. of Germany . | |
| 1776135 | 9/1968 | Fed. Rep. of Germany . | |
| 565027 | 10/1944 | United Kingdom . | |
| 1290588 | 9/1972 | United Kingdom . | |

*Primary Examiner*—Stephen Marcus
*Assistant Examiner*—Mark Thronson
*Attorney, Agent, or Firm*—Ladas & Parry

[57] ABSTRACT

A finned tube for a heat exchanger has an inner surface in which is provided raised portions which are in rows and extend in the longitudinal direction of the tube. The raised portions are arranged, within each row, at irregular intervals and each raised portion may either increase or decrease toward a radially inward tip. The raised portions may have a cross-section which is substantially triangular or trapezoidal or in the shape of a parallelogram and lateral surfaces of the raised portions, together with the internal surfaces of the tube are roughened during drawing. In a process of making such a tube, an unhardened tube having a plurality of circumferentially disposed longitudinally extending fins is drawn through a die so as to subject the tube to a cross-sectional decrease of at least 50% to thereby fragment the fins to provide gaps between remaining raised portions of the fins. A drawing die for use in the process has an entry angle $\alpha \geqq 40°$.

6 Claims, 4 Drawing Figures

FINNED TUBE FOR A HEAT EXCHANGER

This invention relates to a finned tube for a heat exchanger.

In particular the present invention relates to a finned tube of the type having raised portions which are present on the inner surface of the tube and which are arranged in rows extending in the longitudinal direction of the tube and which possess lateral surfaces which also extend in the longitudinal direction of the tube.

A finned tube of the said type, as described in German Auslegeschrift 2,032,891, possesses raised portions on the inner surface of the tube which essentially have the shape of truncated pyramids. Although, compared to a smooth tube, a tube of this type presents advantages related to heat technology, because, for example when being operated as an evaporator, the heat transfer characteristics for the coolant can be improved through the generation of turbulence at the raised portions, the latter, and other factors, nevertheless necessitates a comparatively laborious procedure for the manufacture of a tube of this type, since it must be produced in two drawing steps, each of which is carried out over a mandrel provided with helical grooves, or with straight grooves.

An object of this invention is to provide a finned tube having internal raised portions, which, while possessing improved heat transfer characteristics, can at the same time be manufactured significantly more easily.

According to this invention there is provided a finned tube for a heat exchanger comprising a tube having an outer surface and an inner surface, raised portions provided on said inner surface which raised portions are arranged in rows extending in a longitudinal direction of the tube and which possess lateral surfaces which also extend in the longitudinal direction of the tube, said raised portions being arranged, within a row, at irregular intervals.

The object is thus achieved, according to the invention, by virtue of the fact that the raised features are arranged, within a row, at irregular intervals so that the generation of turbulence is significantly promoted by the irregular arrangement of the raised portions.

The width of each raised portion may either increase or decrease in a smooth manner, in the radially inward direction towards the tips of the raised portions.

The ends of the raised portions may be expediently rounded off, the raised portions having, in particular, a triangular cross-section, or a flattened cross-section.

The lateral surfaces of the raised portions preferably converge at each end, to form an edge.

The raised portions may each have, in longitudinal section, an approximation, to the shape of a trapezium, or the shape of a parallelogram which each face in the same direction, that is to say, acutely inclined edges point in one direction of the tube, whilst obtusely inclined edges point in the other direction.

It is advisable, in order to multiply the number of bubble nuclei of a coolant in use, to form the lateral surfaces and the ends of the raised portions, and the inside surfaces of the tube between the raised portions, so that they are roughened.

An additional contribution may be made to improve the heat transfer in the outward direction when the gaps between individual raised features extend as far as the root circle of the raised features, and when the outside surface of the finned tube is slightly corrugated.

A process for manufacturing the finned tube according to the invention is a further aspect of the invention.

The process provides an initial tube, having a plurality of circumferentially disposed internal fins each extending in the longitudinal direction of the tube, work-hardening the tube in a drawing die and subjecting, during drawing, the tube to a diameter-reduction using a cross-sectional decrease of at least 30%, and preferably 35 to 50%, accompanied by necking of the tube.

In this context, the term "necking" should be understood as meaning that the work-hardened tube in the drawing die is initially drawn in with a small radius of curvature, and is subsequently bent back, in the opposite direction, with a radius of curvature which is equally small.

In this context, the undermentioned quantity is defined as the cross-sectional decrease:

$$\frac{\text{Area of the cross-section of the tube before the diameter-reducing draw} - \text{Area of the cross-section of the tube after the diameter-reducing draw}}{\text{Area of the cross-section of the tube before the diameter-reducing draw}}.$$

As a result of severe necking and the heavy diameter-reducing draw, the original longitudinal fins tear, and irregularly arranged raised portions are formed. At the same time, rough surfaces are obtained on the inside of the tube.

In contrast to the customary sequence of approximately 4 to 6 drawing steps, only two drawing steps preferably have to be carried out according to the process in accordance with the invention, an approximately true-to-scale reduction of the tube being achieved without using a profiled internal mandrel. In addition, it is possible to obtain smaller wall thickness than was previously the case. The grain size of the starting tube plays a decisive part in the formation of the tears; the coarser the grain, the greater is the susceptibility to tearing and the deeper are the tears. The grain size $D_K$ of the starting tube is at least 0.100 mm, preferably 0.150 to 0.300 mm.

It is, moreover, advisable to use an unhardened tube, preferably an extruded tube, as the starting tube. In a preferred embodiment of the invention, the Vickers hardness HV of the work-hardened tube is thus 200 to 250% of the Vickers hardness of the unhardened starting tube.

The invention further relates to a drawing die for carrying out the process according to the invention.

The drawing die is characterised by an entry angle $\alpha \geqq 40°$ and by a sharp edge at the transition from the conical portion to the cylindrical portion. An entry angle $\alpha = 45°$ to $50°$ is preferred.

The invention will now be described, by way of example, with reference to the accompanying drawings, in which.

Figure 1:
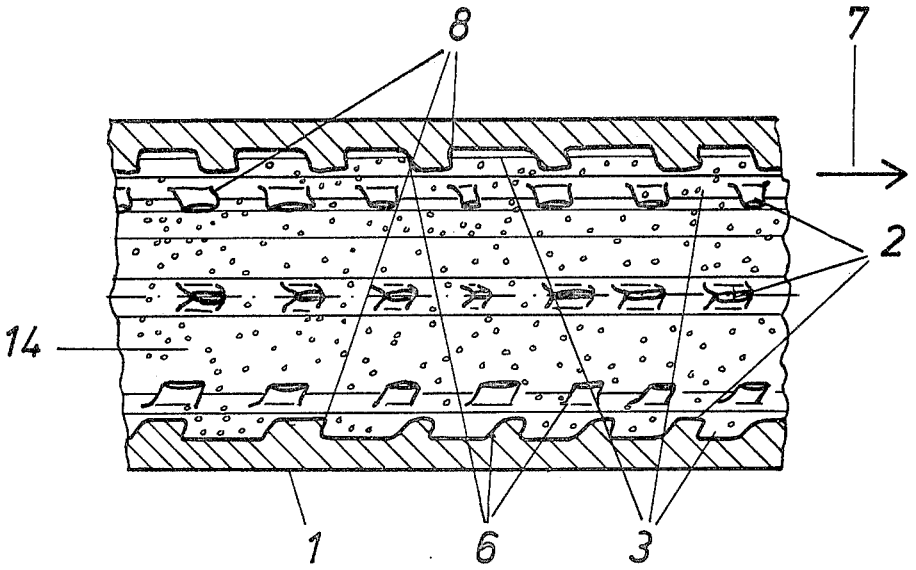
FIG. 1 shows a longitudinal section of a finned tube in accordance with the invention.
Figure 2:
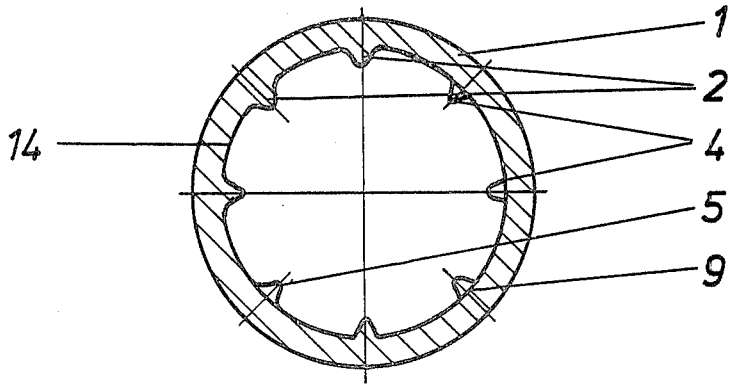
FIG. 2 shows a transverse section through an embodiment of the finned tube according to FIG. 1.

The finned tube 1 shown in FIGS. 1 and 2 has internally raised fin portions 2 separated by gaps 3, the portions 2 being arranged in rows extending in the tube's longitudinal direction and being irregularly spaced in each row. The tube is formed by diameter-reducing drawing of a work-hardened tube previously unhardened and provided with internal longitudinal fins, and as a result of the diameter-reducing drawn the longitudinal fins undergo tearing resulting in the irregularly arranged fin portions 2 separated by the gaps 3.

As shown in FIG. 2, the internally raised portions 2 retain the original shape of the longitudinal fins, that is, lateral surfaces 4 of the raised portions 2 extend in the longitudinal direction of the tube, and the width of each raised portion 2 in a circumferential direction, smoothly decreases in a radially inward direction towards a tip 5 of each raised portion.

Referring to FIG. 1, the raised portions 2 essentially have the shape of parallelograms, which all face in the same direction. The raised portions 2, in the longitudinal direction have edges 6, 8 which form an acute angle with the drawing direction of the tube, indicated by arrow 7.

In the present exemplary embodiment, the gaps 3 extend as far as the root circle 9 of the raised portions 2 but the rough formation of the lateral surfaces 4 and of the inner surfaces 14 of the tube, between the raised features 2, is not illustrated.

Figure 4:
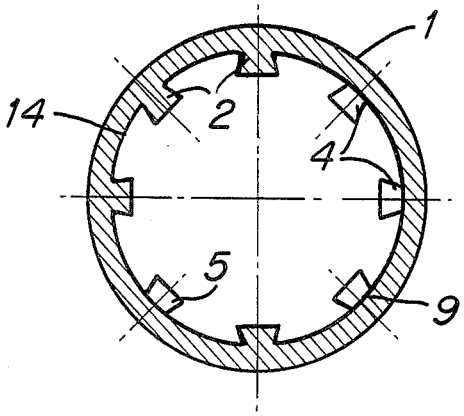
FIG. 4 shows a transverse section through a second embodiment of a finned tube according to the invention.

In altenative embodiments of the invention the width of each raised portion in a circumferential direction smoothly increases in a radially inner direction towards a tip 5 of each raised portion (see FIG. 4). Furthermore, the tips 5 of the raised portions, instead of being rounded, may be flattened off. In yet another alternative embodiment, the raised portions 2 each have a longitudinal cross-section which exhibits approximately the shape of a trapezium. Furthermore, the outer surface of the finned tube may, instead of being smooth, be slightly corrugated.

Figure 3:
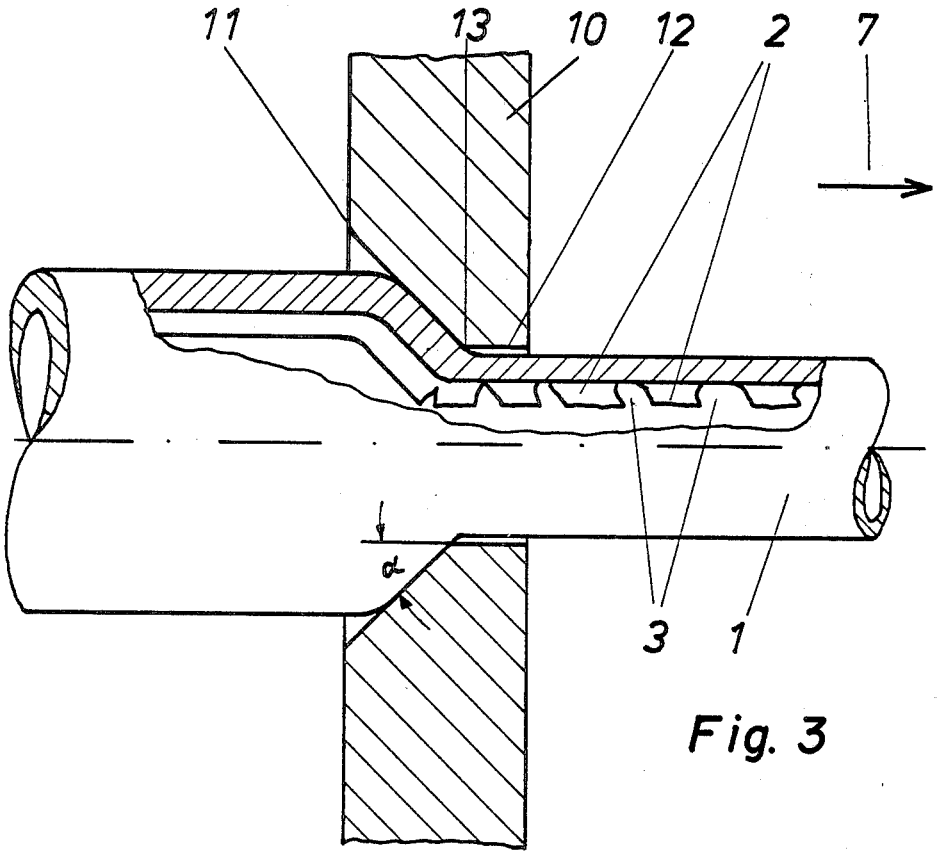
FIG. 3 shows a longitudinal section through a drawing die of an aspect of the invention.

The formation of the tears in the longitudinal fins will now be explained with reference to FIG. 3. The initial unhardened tube, provided with circumferentially disposed longitudinal fins is driven into a drawing die 10 in the direction of arrow headed lines 7. Because of a sharp edge 13, in the die entry the tube is bent through an angle $\alpha$ in the range of 45°to 50°. The tears forming gap 3 are formed while the tube is conically shaped by a portion 11 of the die and the tube is necked down to the cylindrical portion 12. Because of the severe deformation of the tube material, on drawing further, the tears are spread further as a result of the elongation of the tube.

An actual example of a tube in accordance with this invention will now be described.

EXAMPLE

Extruded copper tubes having an outside diameter of 28 mm and having 20 internal fins were available as starting tubes. The grain size $D_K$ was 0.150 mm. These extruded tubes were work-hardened by drawing-down to tubes having the following data:

| | |
|---|---|
| Outside diameter | 23 mm |
| Wall thickness | 1.20 mm |
| Fin Height | 1.80 mm |
| Vickers Hardness HV | 103 |

The work-hardened tubes were drawn in two steps:

| | | |
|---|---|---|
| 1st Draw | Diameter of the drawing die | 19.1 mm |
| | Entry angle $\alpha$ of the drawing die | 48° |
| | Outside diameter of the tube | 17.2 mm |
| | Wall thickness of the tube | 1.00 mm |
| | Fin height | 1.45 mm |
| | Decrease in cross-section | 36% |
| 2nd Draw | Diameter of the drawing die | 13.5 mm |
| | Entry angle $\alpha$ of the drawing die | 48° |
| | Outside diameter of the tube | 12.0 mm |
| | Wall thickness of the tube | 0.80 mm |
| | Fin height | 1.10 mm |
| | Decrease in cross-section | 45% |

The internal fins of the tubes, treated in this way, were torn down to the tube internal root material.

An extruded tube may be used as the initial tube and the Vickers hardness of the work-hardened tube is 200 to 250% of the Vickers hardness of the unhardened, initial tube.

The advantages of tubes made by the present invention in relation to heat technology, becomes evident when, for example, they are employed in coaxial evaporators. Coaxial evaporators usually consist of one or more inner tubes, over which a jacket-tube is pushed. The water flows in the space between the inner tubes and the jacket-tube, and the coolant which is fed in a counter-direction to the water, evaporates in the inner tubes.

the data describing a coaxial evaporator, using the finned tubes according to the invention as inner tubes, and the data relating to a coaxial evaporator using conventional five-rayed star-section tubes having the designation 5-12-08 (five-rayed, outside diameter 12.0 mm, wall thickness 0.80 mm) are summarised in the Table which follows:

| | Coaxial evaporator using inner tubes according to the invention | Coaxial evaporator using star-section inner tubes |
|---|---|---|
| Jacket-tube (mm) | $\phi$ 35 × 1 | $\phi$ 35 × 1 |
| Inner tube | | |
| Outside diameter (mm) | 12.0 | 12.0 |
| Wall thickness (mm) | 0.8 | 0.8 |
| Number of inner tubes | 3 | 3 |
| Coil diameter (mm) | $\phi$ 450 ± 5 | $\phi$ 450 ± 5 |
| Number of turns | 3.5 | 3.5 |
| The operating data were | | |
| Evaporation temperature | $t_o$ = 0° C. | |
| Water inlet temperature | $t_{W1}$ = 12° C. | |
| Coolant | R 22 | |

It was found that the coaxial evaporator using the inner tubes according to the invention exhibited a capacity which was approximately 20% higher than that of a coaxial evaporator using star-section inner tubes, for identical external geometries (identical structural volume, identical weight), and the same pressure-drop on the water side.

We claim:

1. A finned tube for a heat exchanger comprising a drawn tube having an outer surface and an inner surface with torn raised portions provided on said inner surface which torn raised portions are arranged in a plurality of rows extending in a longitudinal direction of the drawn tube and which possess lateral surfaces which also extend in the longitudinal direction of the drawn tube and are longer than the width of of the torn raised portions, said torn raised portions being arranged, within each row, at irregular intervals.

2. A finned tube as claimed in claim 1, wherein the width of each raised portion smoothly decreases from said inner surface in a radially inward direction towards a tip of each raised portion.

3. A finned tube as claimed in claim 1, wherein the width of each raised portion smoothly increases from said inner surface in the radially inward direction towards a tip of each raised portion.

4. A finned tube as claimed in claim 1, wherein the raised portions each have a longitudinal cross-section which exhibits approximately the shape of a trapezium.

5. A finned tube as claimed in claim 1, wherein the raised portions each have a longitudinal cross-section which exhibits approximately the shape of a parallelogram and which all face in the same direction.

6. A finned tube as claimed in claim 1, wherein the lateral surfaces and the tips of the raised portions, as well as the internal surfaces of the tube, between the raised portions are roughened.

* * * * *